United States Patent [19]

Taddeo

[11] 4,276,446

[45] Jun. 30, 1981

[54] ACOUSTIC TRANSDUCER SYSTEM

[76] Inventor: Anthony R. Taddeo, 800 Corwin Rd., Rochester, N.Y. 14610

[21] Appl. No.: 82,034

[22] Filed: Oct. 5, 1979

[51] Int. Cl.[3] ..... H04R 1/20

[52] U.S. Cl. ..... 179/1 E; 181/145; 181/163

[58] Field of Search ..... 181/145, 144, 146, 147, 181/163; 179/1 E

[56] References Cited

U.S. PATENT DOCUMENTS

| | | | |
|---|---|---|---|
| 3,554,313 | 1/1971 | Young | 181/155 |
| 4,139,734 | 2/1979 | Fincham | 179/1 E |
| 4,176,253 | 11/1979 | Gabr | 179/1 E |
| 4,199,657 | 4/1980 | Lane | 181/145 |

FOREIGN PATENT DOCUMENTS

| | | | |
|---|---|---|---|
| 1403354 | 8/1975 | United Kingdom | 179/1 E |
| 1489629 | 8/1977 | United Kingdom | 179/1 E |

*Primary Examiner*—George G. Stellar
*Attorney, Agent, or Firm*—Shlesinger, Fitzsimmons & Shlesinger

[57] ABSTRACT

At least one active and one inactive speaker element or radiator are mounted in each of a plurality of differently sized speaker housings, each of which housings has a fundamental resonant frequency different from each of the other housings. An audio signal is applied simultaneously to each of the active radiators, which in turn create in each housing acoustical wave forms which drive the associated inactive speaker.

3 Claims, 1 Drawing Figure

ACOUSTIC TRANSDUCER SYSTEM

Figure 1:
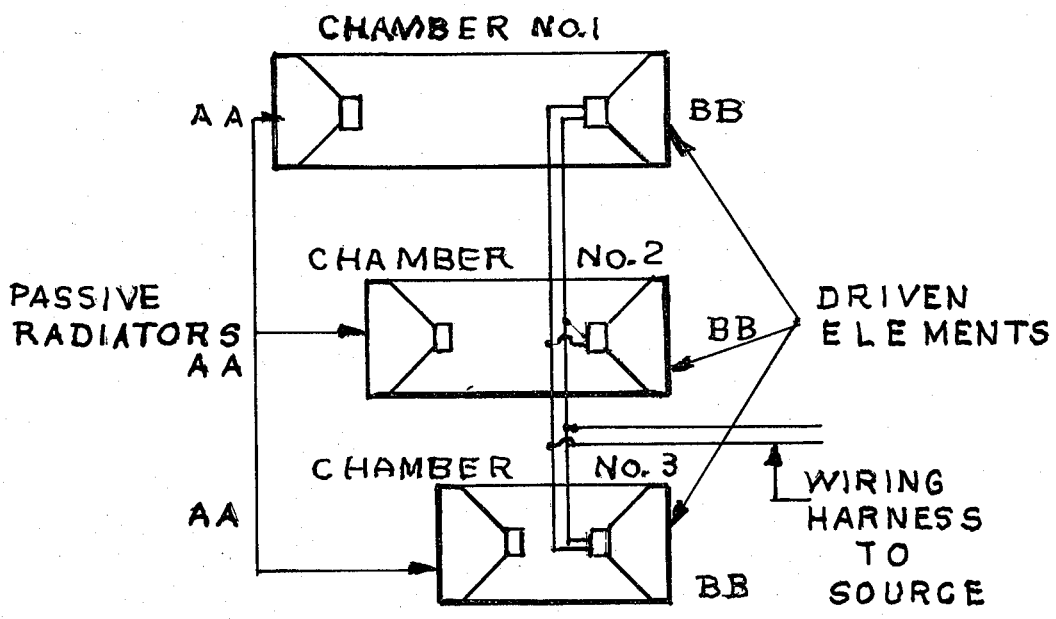

This invention relates to acoustical speaker systems, and more particularly to a novel speaker system comprising a plurality of speaker housings each containing a combination of passive and driven speaker elements or radiators.

As is well known by those skilled in the art, the loudspeaker diaphragm or sound radiating element of a conventional loudspeaker can be operated or driven by electrical signals, such as for example by audio signals applied to a transducer in the speaker; or alternatively a speaker radiator can be of the passive variety which, instead of being driven by an electrical signal, is designed to be driven or operated acoustically by other sound waves. Also as is known by one skilled in the art, most conventional loudspeaker enclosures are designed to minimize enclosure resonances.

A primary object of this invention, however, is to emphasize and to utilize such enclosure resonances for the purpose of driving otherwise passive radiators or speaker diaphgrams which are mounted in the same speaker housing in spaced relation to one or more electrically driven speakers. A fitting analogy for comparing applicant's novel speaker system to a conventional speaker system, would be the comparison of a mulitonal device such as a pipe organ to a monotonal device such as a drum.

Other objects of the invention will be apparent hereinafter from the specification and from the recital of the appended claims, particularly when read in conjunction with the accompanying drawing.

In the drawing, FIG. 1 is a combination wiring diagram and schematic illustration of one embodiment of this invention.

Referring now to the drawing, FIG. 1 illustrates three separate enclosures or chambers No. 1, 2 and 3, which, in the embodiment illustrated, have substantially equal cross sectional areas, but each of which differs in length from the other. Mounted in one end (the right end as shown in the drawing) of each of the chambers 1, 2 and 3 is a conventional audio speaker or radiator BB which has its cone or diaphragm facing toward the right or open end of the chamber in which the respective speaker is mounted. Also as shown in the drawing, the drivers for these three active speakers are connected in parallel by a wiring harness to a conventional signal source, for example to the output of a phonograph amplifier or the like, so that audio signals are simultaneously applied to each of the driven elements in a manner which will be readily apparent to one skilled in the art.

Mounted in the oppposite or left end of each of the chambers 1, 2 and 3 is a passive radiator or speaker AA the diaphragm or cone-shaped end of which also faces outwardly or toward the left hand, open end of the chamber, and away from the direction in which the cones of the speakers BB face.

In the embodiment illustrated each of the housings defining chambers 1, 2 and 3 is made from identical tubing cut into different lengths, the longest length of tube defining chamber No. 1, the shortest length defining chamber No. 3, and the medium or intermediate length of tube defining chamber No. 2. Also as will be apparent from an examination of the drawing, the passive radiators AA and the driven radiators or speaker elements BB are of the same nominal dimensions. Because each of the chambers No. 1, 2 and 3 differs in length from the other, it will be readily apparent that each will have a different fundamental resonant frequency.

In use, when audio signals are applied by the wiring harness to the radiators BB, the passive radiators AA, which by virtue of the chambers in which they are mounted are acoustically or pneumatically coupled to the driven elements BB, will reflect, to varying degrees, the audio signal represented by the associated driven element BB, and will also add to the signal or wave form which is developed in each chamber a component which will be dictated by the respective chamber's fundamental resonant frequency. Obviously when a component of the original complex wave form, which is generated in the chamber as a result of the operation of its associated driven element BB, has a resonance close to that of the associated chamber resonance (or a harmonic thereof), a degree of amplification of that particular component will occur. As a consequence, because of the multiplicity of chambers, complex wave forms of multiple overtone structures may be reproduced from the original audio signals applied to the driven elements. The system therefore can emphasize these particularly overtones, which otherwise often have a tendency through signal processing, transmission and amplification, to decay.

From the foregoing it will be apparent that the present invention provides a novel system for improving overall tone reproduction for audio signals, and the like. By using a plurality of chambers of different sizes and/or shapes, each of which has therein at least one active and one passive radiator or speaker, it is possible to emphasize overtones which might otherwise be lost. Obviously the invention could be modified, for example by using differing size radiators and drivers, or differing size enclosures, radiators and drivers in combination. The driven elements may be wired in series, parallel or series-parallel. Crossover networks and supplemental elements such as conventional woofers and tweeters may be added to augment the device without departing from this invention.

Moreover, while the invention has been illustrated and described in detail in connection with only one embodiment thereof, it will be apparent, as noted above, that it is capable of still further modification, and that this application is intended to cover any such modifications as may fall within the scope of one skilled in the art or the appended claims.

I claim:

1. An acoustical speaker system, comprising a plurality of speaker housings each having therein a chamber, an active speaker element mounted in each of said chambers adjacent one end thereof and disposed to be connected to an electrical audio signal source to be driven thereby, and a passive speaker element mounted in each of said chambers adjacent the opposite end thereof and acoustically coupled to the associated driven speaker in said chamber, thereby to be driven by the acoustical signals developed in said chamber by said associated speaker, and each of said chambers having a fundamental resonant frequency which is different from that of each of the other chambers.

2. An acoustical speaker system as defined in claim 1 wherein each of said chambers has a size different from each of the other chambers.

3. An acoustical speaker system as defined in claim 2, wherein each of said chambers is circular in cross section and has an axial length different from the respective axial lengths of the other chambers.

* * * * *